United States Patent [19]

Thompson

[11] Patent Number: 4,886,947

[45] Date of Patent: Dec. 12, 1989

[54] CLOSURE SYSTEM AND METHOD OF FORMING AND USING SAME

[75] Inventor: Mortimer S. Thompson, Maumee, Ohio

[73] Assignee: Tri-Tech Systems International, Inc., Maumee, Ohio

[21] Appl. No.: 63,164

[22] Filed: Jun. 17, 1987

[51] Int. Cl.[4] ..... B65D 41/42

[52] U.S. Cl. ..... 215/318; 215/333; 215/337; 53/485; 264/295; 264/339

[58] Field of Search ..... 53/485, 490; 264/295, 264/296, 339; 215/318, 321, 333, 337, 324, 328

[56] References Cited

U.S. PATENT DOCUMENTS

| | | | |
|---|---|---|---|
| 521,788 | 6/1894 | Flanigan | 215/321 |
| 953,513 | 7/1910 | Love . | |
| 1,770,548 | 7/1930 | Oven . | |
| 2,340,353 | 2/1944 | Weaver . | |
| 2,385,105 | 5/1959 | Heyl et al. . | |
| 2,423,295 | 7/1947 | Crabbe et al. . | |
| 2,447,340 | 8/1948 | Jackson . | |
| 2,456,560 | 12/1948 | Keith . | |
| 2,852,054 | 9/1958 | Motley . | |
| 2,961,119 | 11/1960 | Leach . | |
| 3,038,624 | 6/1962 | Wieckmann . | |
| 3,065,677 | 11/1962 | Loeser | 264/296 UX |
| 3,171,458 | 3/1965 | Strong . | |
| 3,200,981 | 8/1965 | Harding . | |
| 3,243,851 | 4/1966 | Reitter, Jr. et al. . | |
| 3,250,417 | 5/1966 | Powers et al. | 215/321 |
| 3,272,369 | 9/1966 | Grimsley . | |
| 3,285,452 | 11/1966 | Moloney et al. . | |
| 3,286,866 | 11/1966 | McIntosh . | |
| 3,339,770 | 9/1967 | Weigand . | |
| 3,343,700 | 9/1967 | Heubl . | |
| 3,344,942 | 10/1967 | Hedgewick . | |
| 3,348,717 | 10/1967 | Treanor . | |
| 3,352,127 | 11/1967 | Skinner, Sr. . | |
| 3,352,448 | 11/1967 | Livingstone . | |
| 3,374,913 | 3/1968 | Zipper . | |
| 3,405,439 | 10/1968 | Uemura . | |
| 3,418,409 | 12/1968 | Hesse et al. . | |
| 3,460,708 | 8/1969 | Leftault, Jr. . | |
| 3,482,725 | 12/1969 | Exton . | |
| 3,532,786 | 10/1970 | Coffman . | |
| 3,557,275 | 1/1971 | Longshaw et al. . | |
| 3,557,985 | 1/1971 | St. Denis et al. . | |
| 3,567,233 | 3/1971 | Stephanich . | |
| 3,612,324 | 10/1971 | Malick . | |
| 3,613,929 | 10/1971 | Treanor . | |

(List continued on next page.)

FOREIGN PATENT DOCUMENTS

| | | | |
|---|---|---|---|
| 764429 | 3/1971 | Belgium . | |
| 0049876 | 10/1981 | European Pat. Off. . | |
| 1811318 | 7/1969 | Fed. Rep. of Germany . | |
| 2829755 | 1/1980 | Fed. Rep. of Germany . | |
| 3523771 | 1/1987 | Fed. Rep. of Germany . | |
| 555488 | 3/1923 | France . | |
| 2306135 | 4/1976 | France . | |
| 2378689 | 1/1978 | France . | |
| 351515 | 1/1961 | Switzerland . | |
| 607702 | 8/1975 | Switzerland . | |
| 788148 | 8/1956 | United Kingdom . | |
| 930866 | 8/1956 | United Kingdom . | |
| 1024762 | 10/1962 | United Kingdom . | |
| 1048727 | 11/1966 | United Kingdom | 215/321 |

OTHER PUBLICATIONS

Cyrogenics (Jul. 1980)—M. Shinohara, T. Kugo, and K. Ono, Superleak-Tight Stainless Steel Hollow O-Ring Seals for Cryogenic Use.

(List continued on next page.)

*Primary Examiner*—Donald F. Norton
*Attorney, Agent, or Firm*—Hedman, Gibson, Costigan & Hoare

[57] ABSTRACT

A closure system including a cap and a container, the cap including a top wall, a depending skirt having a bottom end and an annular projection integral with the bottom end of the skirt and having a curled free end portion which has grooves formed by threads in the neck when the cap is pressed on the container in sealed relationship.

32 Claims, 3 Drawing Sheets

U.S. PATENT DOCUMENTS 3,784,041 1/1974 Birch .
3,820,799 6/1974 Abbes et al. .
3,861,551 1/1975 Hannon .
4,016,996 4/1977 Aichinger et al. .
4,069,937 1/1978 Smalley .
4,090,631 5/1978 Grussen .
4,091,948 5/1978 Northup .
4,141,463 2/1979 Smith .
4,143,785 3/1979 Ferrell .
4,153,172 5/1979 Bialobrzeski .
4,196,818 4/1980 Brownbill .
4,202,462 5/1980 Imber .
4,206,852 6/1980 Dunn et al. .
4,209,102 6/1980 Dunn et al. .
4,210,251 7/1980 Grussen .
4,218,067 8/1980 Halling .
4,253,581 3/1981 Aichinger et al. .
4,257,525 3/1981 Thompson .
4,274,544 6/1981 Westfall .
4,281,774 8/1981 Mumford .
4,281,979 8/1981 Doherty .
4,290,614 9/1981 Moll .
4,343,408 8/1982 Csaszar .
4,345,692 8/1982 Obrist et al. .
4,360,114 11/1982 Owens .
4,360,149 11/1982 Hein .
4,386,044 5/1983 Arndt et al. .
4,392,579 7/1983 Uhlig et al. .
4,394,918 7/1983 Grussen .
4,418,828 12/1983 Wilde et al. .
4,442,947 4/1984 Banich, Sr. .
4,470,513 9/1984 Ostrowsky .
4,475,274 10/1984 Beckstrom et al. .
4,497,765 2/1985 Wilde et al. .
4,506,795 2/1985 Wilde et al. .
4,506,975 3/1985 Herr .
4,550,844 11/1985 Lininger .
4,552,279 11/1985 Mueller et al. ..... 215/318
4,563,325 1/1986 Coffman .
4,595,547 6/1986 Herr .

FIG. 1
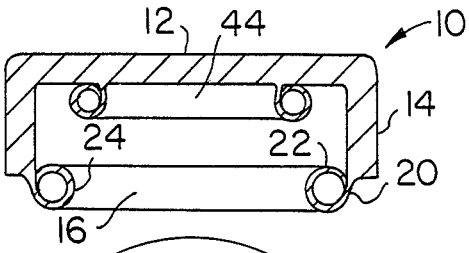
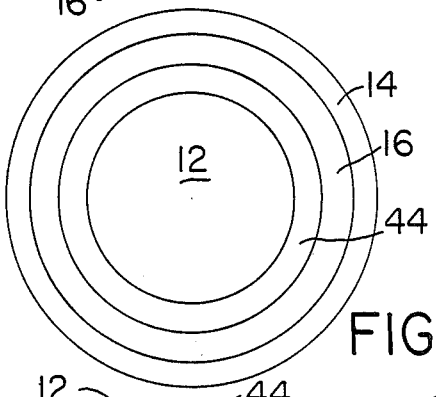
FIG. 2
FIG. 3
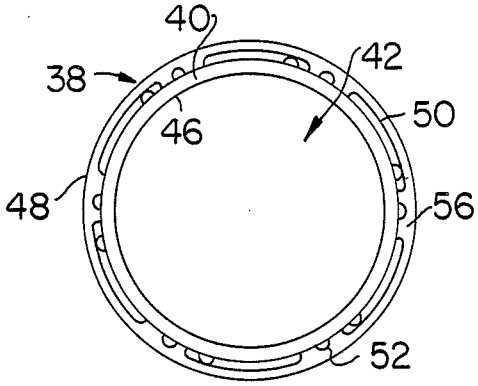
FIG. 4
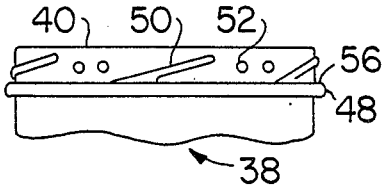
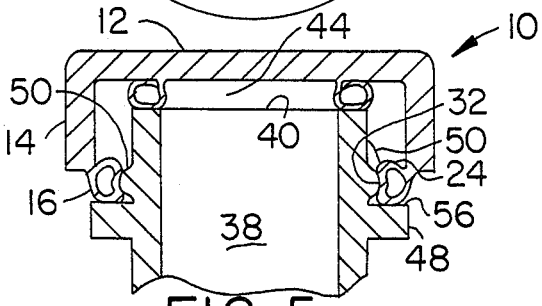
FIG. 5
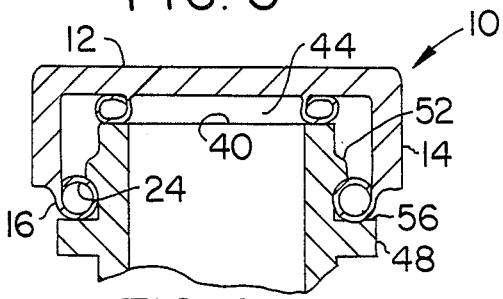
FIG. 6
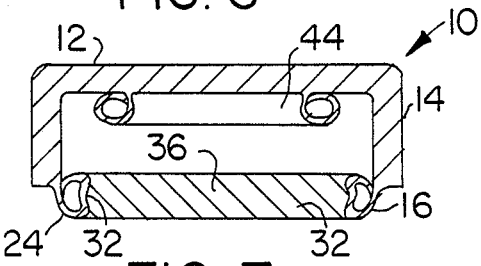
FIG. 7
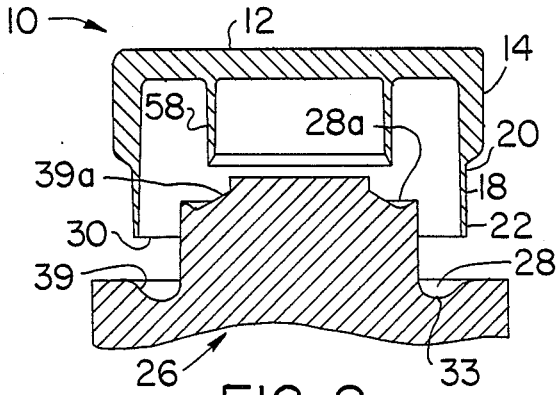
FIG. 8
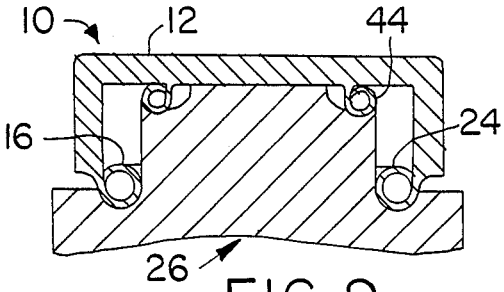
FIG. 9

FIG. 10
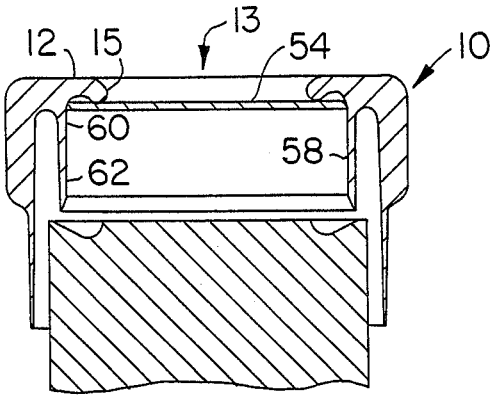
FIG. 15
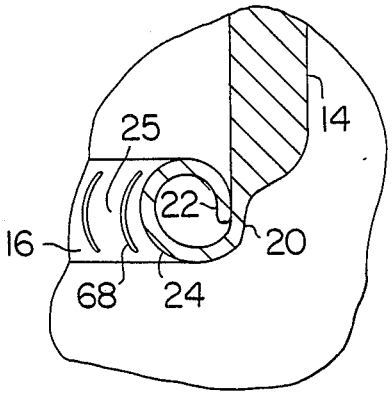
FIG. 11
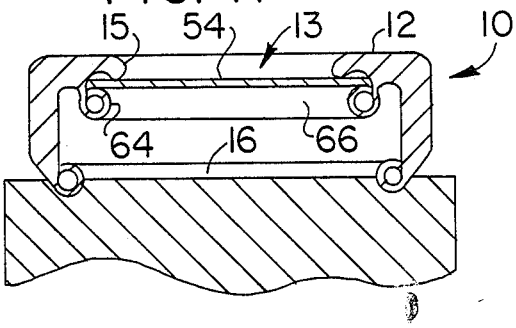
FIG. 16
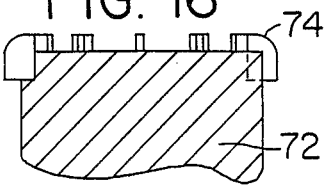
FIG. 17
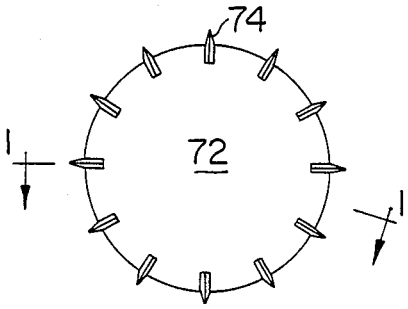
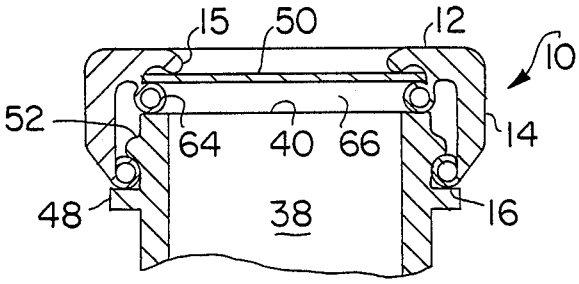
FIG. 12
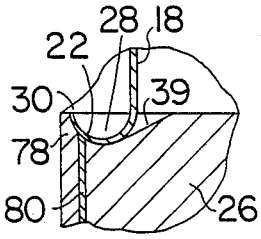
FIG. 13
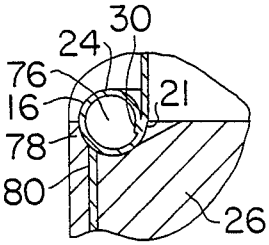
FIG. 14
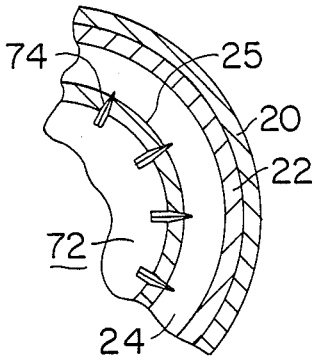
FIG. 18

CLOSURE SYSTEM AND METHOD OF FORMING AND USING SAME

FIELD OF THE INVENTION

This invention relates to caps and containers for forming a sealable closure system, especially for vacuum packed products and particularly to caps which may be pressed onto the container and then twisted off.

BACKGROUND OF THE INVENTION

Metal caps with plastisol liners popularly known as press-on twist-off or P-T caps are widely used by vacuum packagers largely because of the capping speed and economy possible and the seal integrity of such closures. Such closures depend on the thread formation in the cap by the compression of the liner by the container neck thread at the elevated temperatures used for such a closure system. However, such closures present problems in removal because of the intimacy of the thread engagement which is formed in situ. The fact that such caps are ordinarily used with vacuum and that metal cap shells offer a poor gripping surface adds to the difficulty of their removal. An additional problem associated with such closure is the difficulty of rethreading them on reclosure because the in situ method of their formation creates too intimate a thread engagement.

Attempts to duplicate or improve on the advantages of low cost, high speed capping with a one piece press-on twist-off plastic cap have been unsuccessful largely due to problems associated with the inability to achieve a cap skirt having the formability characteristics during the capping process and the mechanical characteristics to provide a positive thread engagement suitable to maintain the closure and sealing integrity while capped and to provide thread definitions with sufficient strength for removal by twisting.

SUMMARY OF THE INVENTION

In accordance with the present invention, there is provided a new and unique closure system for closing a package consisting of a container and a cap, wherein the closure provides improved convenience, performance and lower cost. The closure system can be used to store solid liquid and gaseous products.

Generally the cap of the invention has a lid and a depending annular skirt including an annular inner projection for engaging a container. The container of the invention has an opening surrounded by a neck including a lip with a finish thereunder for providing an interfering engagement with the annular projection of the cap upon closing the package and threaded engagement with it for opening the package. The caps annular projection or ring is made of plastic and includes a highly resilient and compressible curled free end portion. As the package is closed, the curled free end portion readily compresses to engage its opposing, coacting neck projections in a tight, compressive engagement. The curled free end of the invention may be located on the cap skirt or optionally on the container neck. In so doing the curled free end is locally deformed to form grooves which are complimentary to threads in of the neck finish which enable the cap to be removed by twisting.

In a preferred embodiment, the curled free end forms an internal projection located on the lower rim of a skirt depending from the cap lid. The container has an opening and a neck with an external annular interfering portion which may be spaced bosses or lugs below which is a protruding bead and therebetween are spaced threads or biased lugs. When the cap is applied to the container neck, the curled free end compresses and moves past the neck interference and is prevented from further movement by the protruding bead so that a tight engagement with the spaced threads is produced whereupon the curled free end accepts the impression of the neck threads.

Preferably both the cap and container neck are at an elevated temperature when engaged to facilitate the shaping of the neck thread impression in the curled free end. Upon cooling to ambient conditions the plastic becomes more rigid and stronger and the thread impression in the curled free end is able to produce a significant lifting movement to the cap from the container neck when twisted. Alternatively the curled free end may be located on the container neck and the thread producing elements may be in the cap.

In a method of the invention, the curled lower portion is formed by a curling tool which engages the lower free end of a cylindrical preform, and turns it inwardly from the skirt and then upwardly channeling and altering the direction of such movement over its working surfaces. Preferably the initiation of the curling action is facilitated by providing a taper to the lower free end of the cylindrical preform. The curling action at this point produces a "J" or "U" shape in such free end. To produce an "O" or coil shape, after leaving the working surface of the tool, the free end takes an upward and inward or outward direction relative to itself, which results from the continuing compression and the stresses imposed by its plastic memory, to complete the formation of a hollow "O" ring. Optionally, the compression of the cylindrical portion can proceed beyond this point and produce a more fully coiled ring.

To facilitate the curling operation or to alter the dimension, shape or character of the resultant curled ring, the curling tool can be heated, spun or rolled along the free end of the cylindrical portion during its shaping. The free end of the cylindrical portion may be curled simultaneously or sequentially. The curled ring can be exposed to elevated temperatures for short periods before capping to alter its dimensions, shape or character or the preform for the curled ring can be heat treated for the same purpose.

An important feature of the invention is that it provides the cap with a highly compressible yet mechanically strong container engaging portion as a result of its hollow, coiled cross section. This makes possible deep and strong thread impressions producing a tight, secure engagement of the closure. It also makes possible a tighter, more secure engagement of the closure for a container which would otherwise be rejected for excessive ovality, vertical misalignment or other problems with the container neck finish thereby introducing additional opportunities for manufacturing cost savings. Such forgiving qualities of the highly compressible curled ring of the invention can be accentuated and optimized by its design employing suitable combinations of a curl radius, wall thickness, arc of curl and other design parameters.

Another feature of the invention is that it may be used in combination with a metal lid employing an integral O-ring linerless seal as described in my copending application Ser. No. 809,058, filed December 12, 1985, now U.S. Pat. No. 4,708,255 issued November 24, 1987.

Still another feature is that the cap may be applied at high speeds in low cost snap-on capping operations while offering the consumer the convenience of a twist-off.

Another feature is that the plastic skirt of the invention may have deep flutes for a very good gripping surface to facilitate cap removal, particularly when an internal vacuum is produced on capping.

Another important feature of the invention is that less extensible plastics may be used for the snap-on closure of the invention than those plastics used popularly for snap-on caps having solid interfering beads (and which must be snapped off past an interference) such as low density polyethylene. This advantage is even greater when compared to traditionally designed snap caps produced from somewhat stiffer plastics such as medium density polyethylene even though the closure of the invention may also employ far stiffer polymers such as medium impact polystyrenes, styrene-acrylonitrile copolymers, polyethylene terephthalate and others. Closures of the invention may employ most commonly used thermoplastics.

A feature derived from the broader selection of polymers made possible by the invention is that lids and caps can be much stronger and stiffer in the lid and skirt portion without increasing the difficulty of disengaging the interference during cap removal. Additionally less costly plastics, such as polypropylene, can be employed and wall thickness can be reduced to produce even further material cost savings as well as still further savings resulting from shorter molding cycles and higher molding machine throughout due to the elimination of cap threads.

The following drawings in which like reference characters indicate like parts are illustrative of the invention and are not meant to limit the invention as set forth in the claims forming part of this application.

BRIEF DESCRIPTION OF THE DRAWINGS

FIG. 1 is a longitudinal cross sectional view of one embodiment of the invention, illustrating a snap-on, twist-off cap having a skirt and a compressible and resilient curled free end for engagement with a container for closing and opening.

FIG. 2 is a bottom plan view of FIG. 1.

FIG. 3 is a top plan view of a container, such as a bottle neck, which may be closed and opened by the caps of the present invention.

FIG. 4 is a longitudinal view of FIG. 3.

FIG. 5 is a longitudinal sectional view of the cap of FIGS. 1 and 2 in engagement with the container of FIGS. 3 and 4 showing the engagement of the cap curled free end with the thread portion and annular bead of the container.

FIG. 6 is similar to FIG. 5 except it is a different longitudinal section view showing the curled free end of the cap engaged with the bosses and annular bead of the container between its thead portions.

FIG. 7 is a longitudinal sectional view of the cap of FIGS. 4 and 5 after it has been removed from the container.

FIG. 8 is a longitudinal sectional view of a method of the invention, illustrating a preformed cap and a tool for curling the free end in the depending wall of the cap.

FIG. 9 generally is the same as FIG. 8 except that the tool has engaged and formed the curled free end in the depending wall of a cap of the invention.

FIG. 10 is a longitudinal sectional view of another method of the invention, illustrating a preformed cap of the invention with a separate metal lid and a tool for curling the free ends of the caps.

FIG. 11 is generally the same as FIG. 10, except that the tool has engaged and curled the free ends of the caps thereby trapping and sealing the metal lid and forming a lower ring for engagement with the container.

FIG. 12 is generally the same as FIG. 6, except that the cap is that illustrated by FIGS. 10 and 11.

FIG. 13 is a longitudinal sectional view of a portion of a tool engaging the free end of a wall of the invention wherein the tool has a heating means to melt the lip of the wall.

FIG. 14 is generally the same as FIG. 13 except that the tool has fully engaged the wall and its lip has been welded to an upper portion of the wall.

FIG. 15 is a longitudinal sectional view of a lower portion of the skirt of a cap of the invention showing a curled free end with peripherally spaced slits.

FIG. 16 is a longitudinal sectional view of the tool employed to produce the slits of FIG. 15.

FIG. 17 is a plan view of the tool of FIG. 16.

FIG. 18 is a plan view of the tool of FIG. 17 in slitting engagement with the curled free end of FIG. 15 shown in section.

DETAILED DESCRIPTION OF THE DRAWINGS

Figure 19:
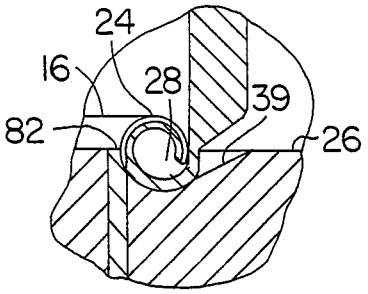
FIG. 19 is a longitudinal sectional view of a portion of a tool of the invention having a scalloped groove edge to produce the illustrated corrugated curled free end of the invention.

Referring to a FIGS. 1 to 5 there is shown a semirigid plastic cap 10 and a cooperating rigid container neck 38 of the invention. The cap 10 has a lid 12 and an integral depending linerless seal 44 as described in my copending application Ser. No. 809,058, filed December 12, 1985, now U.S. Pat. No. 4,708,255 issued November 24, 1987 and a depending peripheral skirt 14 including a lower engaging ring 16. The ring 16 has an upper end 20 integral with the skirt 14 and a free end 22 including a curled portion 24. The container neck 38 has a bore 42, a rim 40, peripherally spaced thread portions 50, peripherally spaced projecting bosses 52 and a peripherally transfer bead 48. FIG. 5 shows the cap 10 in a closed and sealed engagement with the container neck 38. To produce the engagement, the cap 10 and container neck 38 are preferentially preheated before capping and cooled to ambient temperatures after capping. During capping the curled portion 24 of the engaging ring 16 is forced axially past the neck projecting bosses 52 and against the upper surface 56 of transfer bead 48, as shown in FIG. 6. In this position, the engaging ring 16 is in compressive engagement with the neck thread portion 50 whereupon it is compressed thereat and assumes the idented inverse shape of the thread portion 50 as shown in FIGS. 5 and 7. At the same time the seal 44 engages and seals the neck rim 40. Thereafter, upon cooling to ambient conditions the cap 10 can be removed from the neck 38 by twisting employing the newly formed cap thread portion 32 to generate the required level of leveraged force against the neck thread 50 to force the ring 16 upwardly past the restraining neck bosses 52. The cap 10 may be reapplied by engaging the newly formed threads 32 of ring 16 with the neck thread 50, twisting and thereby snapping the ring portions 36 which are intermediate the ring thread portions 32 past the interfering neck bosses 52 into a closed and sealed engagement.

Referring to FIGS. 8 and 9, there is shown a preferred method of forming the curled portion 24 of the engaging ring 16. In FIG. 8 the cap 10 already has been formed by conventional molding techniques, such as injection molding, with a vertical cylindrical or tubular wall 18 having its upper end 20 integral with the skirt 14 and its lower free end 22 ready for curling by the illustrated curling tool 26. As shown in FIG. 8, the wall 18 and the curl 24 are free of abrupt changes in thickness.

The curled portion 24 of the ring 16 is formed with a curling tool 26, which in FIG. 8 has been positioned below the cap 10 ready to engage the preformed wall 18 at its lip or rim 30. The curling tool 26 includes an annular groove 28 having a concave cross section suitable for shaping and dimensioning the curled portion 24.

As shown in FIG. 9, the forming operation is accomplished by pressing the groove 28 of the tool 26 against the rim 30 of the wall 18. In this embodiment the deepest portion 33 of the groove 28 representing the center of its concavity is located inwardly of the cylindrical plane of the wall 18. Also the groove 28 has a slanted portion 39, outwardly and tangent to its concavity to facilitate centering of the tool and cap. As movement of tool 26 relative to the wall 18 continues toward the lid 12, the cylindrical sides of the wall 18 are centered within groove 28 by the slanted portions 39 and are then forced inwardly and then upwardly and finally outwardly in response to its plastic memory to assume the desired curved shape 24 having an "0" cross section. At the same time the groove 28*a* of tool 26 performs the same operation outwardly on wall 58 to produce the O-shape linerless seal 44.

To facilitate the curling operation, in the case of polypropylene, the tool 26 may be at a temperature of about ambient to about 300 degrees F but preferably about 150 to about 300 degrees F for curling cycles of about one-half to two seconds. The curl radius of the groove 28 and the resultant ring 16 may range from 0.030 to 0.100 inches or larger when used in conjunction with wall 18 thicknesses of about 0.003 to 0.025 inches. The thickness of wall 18 may desirably be tapered to include free ends 22 about 0.003 to 0.15 inches and upper ends 20 of from 0.010 to 0.025 inches.

Referring now to FIGS. 10 to 12 there is shown a cap of the invention including a linerless seal 66 and a separate lid 54. FIG. 10 shows a cap 10, as molded, including a lid 12 having a central opening 13 bounded by a depending wall 58 with an upper portion 60 and a free end 62. The central opening 13 is bounded at the lid upper surface by an inward projection 15. Located in the opening 13 is a metal lid portion 54 which abuts the lid inward projection 15 and is bounded by upper wall portion 60. FIG. 11 shows the cap 10 with its metal lid portion 54 after the wall 58 has been curled by the method of the invention as shown in FIGS. 8 and 9 except that the curled portion 64 is inwardly directed so as to fixedly engage the metal lid portion 54 in a sealing engagement. The cap 10 is now ready for capping a container and the curled portion 64 of its linerless seal 66 preforms a sealing engagement on both the container neck and the cap metal lid portion 50 as shown in FIG. 12. Optionally, the central lid portion 50 may be made of other materials such as plastic: which offer transparency, gas barrier, cost or other advantages.

FIGS. 13 and 14 show a curled portion 24 which is welded to produce a sealed enclosure 76 resulting in a ring 16 having pneumatic qualities and highly resistant to any uncurling forces. There is shown a tool 26 having a groove 28 which includes an annular segment 78 at its outer periphery which is heated and an intermediate portion 80 which is a heat insulator. The free end 22 adjacent the rim 30 is particularly thin and as the rim 30 is forced over the surface of groove 28 and meets the heated groove segment 78 it melts and retains its melted condition until it completes its curl and abuts an inner portion 21 of the curl 24 whereupon it fuses. The remainder of the curl 24 which is in contact with the heated segment 78 is thicker than the free end 22 and, therefore, does not melt. The period for which the thin free end 22 is in contact with heated segment 78 can be proportionately longer than for succeeding wall 18 portions to facilitate the ring fusing operation. Additionally the free end 22 may be welded to the inner portion 21 of the curl 24 after the curling operation.

Referring now to FIGS. 15 to 18, there is shown another embodiment wherein the interal wall 25 of the curl 24 of the invention is slit radially to provide enhanced resilience during a compressive closing engagement. FIG. 15 shows a cross section of an inwardly curled free end 24 showing a slit 68 on the inner portion 25. The slits serve the purpose of eliminating the hoop strength of inner portion 25 so that resistance to compression is lessened and the impression by the neck thread portion 50 shown in FIGS. 3 and 4 is facilitated. FIGS. 16 and 17 show a slitting tool 72 with slitting elements 74 spaced radially about its upper periphery. To produce the slitted ring 16, the curled free end 24 is first produced by the method described in FIGS. 8 and 9 and then the slitting tool 72 is brought into engagement with it to produce the slits (see FIG. 18). Optionally, the slits 68 may be produced to extend to the lip 30 of the free end 22 after curling or slitting the wall 18 may be done prior to or during curling.

Figure 20:
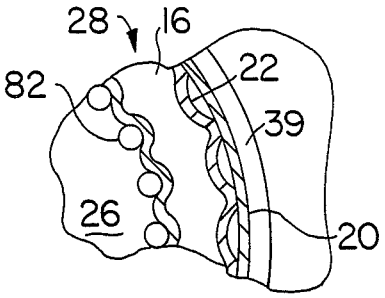
FIG. 20 is a plan view of the tool and free end of FIG. 19.

FIGS. 19 and 20 show a corrugated ring 16 which provides greater flexibility and ease of movement past interfering beads. The method for its production employs a tool 26 in which a series of cylindrical pins 82 are positioned around the inside periphery of the groove 28 so that a generally corrugated surface is formed thereat which shapes the curl 24 of the ring 16 into the desired corrugated shape over its inner and upper portions.

Figure 21:
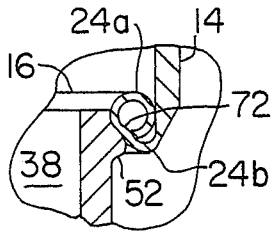
FIG. 21 is a longitudinal sectional view of a curled free end of the invention having a relatively flat portion intermediate its curled portions in early engagement with a snap fit container.
Figure 22:
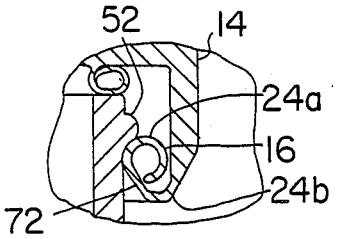
FIG. 22 is the same as FIG. 21 except that the curled free end has been fully engaged with the container.
Figure 23:
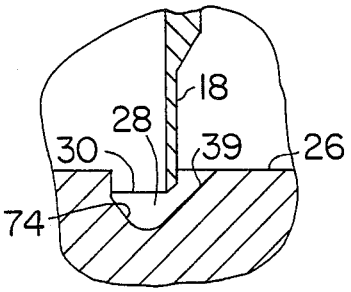
FIG. 23 is a longitudinal sectional view of a portion of a tool of the invention having a groove designed to produce the curled free end of FIGS. 21 and 22 and a wall about to be reformed.
Figure 24:
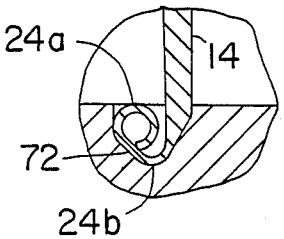
FIG. 24 is the same as FIG. 23 except that the wall has been formed into the curled free end having a flat portion.

Referring to FIGS. 21 and 24 there is shown an embodiment wherein the ring 16 is produced to have a radial cross section having two curved portions with a relatively straight intermediate portion 72 which reduces the strength of the ring in a radial direction but increases it in an axial direction. FIG. 21 shows a ring 16 consisting of curled portions 24*a* and 24*b* with an intermediate portion 72 being forced onto the container neck 38 past its annular bead 52. The relatively straight section 72 is more readily compressed in the radial direction than a typical "O" shape ring 16. FIG. 22 shows the curled portion 24*a* in engagement with bead 52 prior to its removal. In this position the relatively straight portion 72 adds columnar strength to the ring 16 structure to better resist its passage past bead 52. FIGS. 23 and 24 show the method of forming the ring 16 wherein the groove 28 of tool 26 has a relatively straight segment 74 which produces its straight portion 72 intermediate the curved portion 24*b* and the curved portion 24*a* which continues to curl back on itself due to plastic memory of the wall 18.

We claim:

1. A cap and container for containing a product comprising:

a cap including;

(a) a top wall, (b) a skirt depending from said top wall having a lower curled free end of plastic, a container for the product including;

(a) an opening for receiving or discharging the product, (b) a neck surrounding the opening, and (c) peripheral threads about said neck adapted to engage and form complementary grooves in said curled free end of the cap when cap is placed on the container, to thereby provide a twist cap for opening and closing the container by virtue of the engagement between said peripheral threads on the container and said complementary grooved, curled free end of the cap.

2. The cap and container of claim 1, wherein said peripheral threads on the container are discontinuous.

3. The cap and container of claim 1, wherein said curled free end on the cap is annular and has a cross sectional shape selected from the group consisting of an O and a coil.

4. The cap and container of claim 1, wherein the container further comprises means for positioning the curled free end of the cap in operable relationship to the peripheral threads of the container when the cap is placed on the container.

5. The cap and container of claim 1, wherein the container further comprises means between said peripheral threads for restraining said curled free end of the cap from upward movement when the cap is placed on the container.

6. The cap and container of claim 5, wherein said restraining means comprises spaced apart projections engageable with said curled free end of the cap.

7. The cap and container of claim 6, wherein said spaced apart projections are bosses.

8. A twist cap for a container having an opening, a neck about the opening and peripheral threads on the neck comprising:

a top wall, a skirt depending from said top wall having a curled lower free end including plastic and adapted to be placed on the container and engaged by the peripheral threads of the container to form complementary grooves therein and provide a twist cap for opening and closing the container by virtue of the disengagement and engagement between the peripheral threads on the container and the complementary grooved curled free end of the cap wherein said curled free end is annular and has a cross sectional shape selected from the group consisting of an O and a hollow coil.

9. The twist cap of claim 8, wherein said free end is curled inwardly.

10. The twist cap of claim 8, wherein said curled free end contains slits therein.

11. The twist cap of claim 8, wherein said curled free end contains corrugation therein.

12. The twist cap of claim 8, wherein depending from said top wall and spaced inwardly from said skirt is a linerless seal.

13. The twist cap of claim 12, wherein said top wall has a opening therein for a lid, and wherein said linerless seal engages said lid for the positioning thereof within said top wall.

14. A method for forming a twist cap for a container having an opening, a neck about the opening and peripheral threads on the neck, comprising:

(a) molding a cap having a top wall and a skirt depending from said top wall having a lower free end of plastic, and (b) curling the free end of said skirt into an annular curled free end having a cross sectional shape selected from the group consisting of an O and a hollow coil, and adapted to be engaged by the peripheral threads of the container to form complementary grooves therein and provide a twist cap for opening and closing the container by virtue of the disengagement and engagement between the peripheral threads on the container and the complementary grooved, curled free end of the cap.

15. The method of claim 14, comprising curling the free end of the cap inwardly.

16. The method of claim 14, comprising slitting the curled free end of the cap.

17. The method of claim 14, comprising corrugating the curled free end of the cap.

18. The method of claim 14, comprising forming a linerless seal within the cap depending from the top wall thereof.

19. The method of claim 18, comprising forming a top wall of the cap with an opening threin for a lid adapted to be positioned in the top wall by the linerless seal.

20. In a container for a twist cap, wherein the container has an opening, a neck about the opening and peripheral threads on the neck, and wherein the twist cap has a top wall, a skirt depending from the top wall and a curled lower free end including plastic and adapted to be placed on the container and engaged by the peripheral threads of the container to form complementary grooves therein and thereby provide a twist cap for opening and closing the container, comprising:

projection means extending from the container neck and between the peripheral threads of the container for engaging the curled free end of the cap and maintaining the engagement between the peripheral threads and the complementary groove in the curled free end of the cap until a predetermined force is applied in twisting off the cap from the container.

21. The container of claim 20, wherein said projecting means are peripherally spaced apart about the neck.

22. The container of claim 21, wherein said projecting means are bosses.

23. The container of claim 21, further comprising a rim extending from and about the neck of the container below and adjacent to the peripheral threads of the container for positioning the curled free end of the cap in operable relationship to the peripheral threads when the cap is placed on the container.

24. A method for forming a twist cap on a container having an opening for the receipt or discharge of fluid, a neck about the opening and peripheral threads about the neck, comprising:

(a) placing the cap over the opening of the container, wherein said cap includes a top wall, a skirt depending from the top wall and a lower curled free end of plastic, and wherein said lower curled free end engages the peripheral threads on the container to form complementary grooves in said curled free end, (b) rotating the cap in one direction to disengage the grooved curled free end of the cap from the peripheral threads of the container for removal of the cap, and (c) rotating the cap in the other direction to engage the grooved curled free end of the cap with the peripheral threads of the container to secure the cap on the container.

25. The method of claim 24 wherein the peripheral threads on the container are discontinuous.

26. The method of claim 24 wherein the curled free end of the cap is an annular projection and has a cross-sectional shape selected from the group consisting of an O and a coil.

27. The method of claim 26 wherein the container further comprises means for positioning the curled free end of the cap in operable relationship to the peripheral threads on the container when the cap is placed on the container.

28. The method of claim 27 wherein the positioning means comprises a peripheral bead contacted by the annular projection of the cap.

29. The method of claim 24 wherein the container further comprises means between the peripheral threads for restraining the curled free end of the cap from upward movement when the cap is pressed on the container.

30. The method of claim 29 wherein the restraining means comprises peripherally spaced apart projections engageable with the curled free end of the cap.

31. The method of claim 30 wherein the spaced apart projections are bosses.

32. A method of forming a cap for a container comprising:

forming a cap having a top wall and a depending skirt having a lower end, and engaging said lower end of the skirt with a curling tool to thereby form a curled free end portion having a cross sectional shape selected from the group consisting of an O and a hollow coil.

* * * * *